US010261437B2

(12) United States Patent
Grinwald

(10) Patent No.: US 10,261,437 B2
(45) Date of Patent: Apr. 16, 2019

(54) LIQUID ELECTROPHOTOGRAPY

(75) Inventor: Yaron Grinwald, Meitar (IL)

(73) Assignee: HP Indigo B.V., Amstelveen (NL)

( * ) Notice: Subject to any disclaimer, the term of this patent is extended or adjusted under 35 U.S.C. 154(b) by 425 days.

(21) Appl. No.: 14/374,706

(22) PCT Filed: Feb. 7, 2012

(86) PCT No.: PCT/EP2012/052069
§ 371 (c)(1),
(2), (4) Date: Jul. 25, 2014

(87) PCT Pub. No.: WO2013/117219
PCT Pub. Date: Aug. 15, 2013

(65) Prior Publication Data
US 2015/0016846 A1 Jan. 15, 2015

(51) Int. Cl.
*G03G 15/06* (2006.01)
*G03G 15/10* (2006.01)
*G03G 15/00* (2006.01)

(52) U.S. Cl.
CPC ..... *G03G 15/065* (2013.01); *G03G 15/10* (2013.01); *G03G 15/6591* (2013.01); *G03G 2215/00523* (2013.01)

(58) Field of Classification Search
CPC .. G03G 15/065; G03G 15/10; G03G 15/6591; G03G 2215/00523
See application file for complete search history.

(56) References Cited

U.S. PATENT DOCUMENTS 2,297,691 A * 10/1942 Carlson ..... G03G 5/08207 101/467
4,076,405 A 2/1978 Silverberg
4,086,873 A 5/1978 Morita et al.
4,204,766 A 5/1980 Harada
5,036,365 A 7/1991 Landa
5,239,344 A 8/1993 Enoki et al.
5,256,509 A * 10/1993 Hayashi ..... G03G 5/14704 430/131
5,289,238 A 2/1994 Lior et al.
5,416,569 A 5/1995 Goldberg
7,283,775 B2 10/2007 Kamimura et al.
(Continued)

FOREIGN PATENT DOCUMENTS

GB 1214149 A 12/1970
GB 2039800 A 8/1980
(Continued)

OTHER PUBLICATIONS

Barry, "Printing nanoparticles from liquid and gas pahses using nanoxerography", Nanotechnology 14, pp. 1057-1063 (2003).*
(Continued)

*Primary Examiner* — Sevan A Aydin
(74) *Attorney, Agent, or Firm* — HP Inc. Patent Department

(57) ABSTRACT

Liquid electrophotography apparatus including a plurality of members defining a flow path for a printing liquid. At least a first member of the plurality of members is arranged to generate an electric field. The liquid electrophotography apparatus also includes a first insulation layer arranged around at least a portion of a surface of the first member to prevent electrical discharge from the printing liquid.

5 Claims, 4 Drawing Sheets

(56) References Cited

U.S. PATENT DOCUMENTS

| | | | | |
|---|---|---|---|---|
| 7,560,215 | B2 | 7/2009 | Sharma et al. | |
| 7,638,252 | B2 * | 12/2009 | Stasiak et al. | 430/120.2 |
| 8,027,625 | B2 | 9/2011 | Kawashima | |
| 2004/0152007 | A1 * | 8/2004 | Combes | G03G 9/0804 430/123.2 |
| 2006/0172219 | A1 * | 8/2006 | Stasiak | G03G 15/221 430/118.6 |
| 2008/0299483 | A1 * | 12/2008 | Mizumoto et al. | 430/130 |
| 2009/0142712 | A1 * | 6/2009 | Kwon | B82Y 10/00 430/325 |
| 2010/0159648 | A1 | 6/2010 | Tombs et al. | |
| 2011/0150513 | A1 | 6/2011 | Kawata et al. | |
| 2011/0236077 | A1 | 9/2011 | Ozaki et al. | |

FOREIGN PATENT DOCUMENTS

| | | | |
|---|---|---|---|
| JP | 58107563 | A | 6/1983 |
| JP | 04277779 | A | 10/1992 |

OTHER PUBLICATIONS

International Searching Authority, International Search Report and Written Opinion, PCT/EP2012/052069, 19 pages, dated Dec. 14, 2012.

* cited by examiner

LIQUID ELECTROPHOTOGRAPY

BACKGROUND

Liquid electrophotography apparatus usually include a plurality of rollers that are arranged to transfer printing liquid onto a substrate (such as paper) to form an image on the substrate. The printing liquid has an opposite electrical charge to the plurality of rollers and is therefore attracted to the plurality of rollers.

BRIEF DESCRIPTION

Reference will now be made by way of example only to the accompanying drawings in which.

DETAILED DESCRIPTION

In the following description, the wording 'connect' and 'couple' and their derivatives mean operationally connected or coupled. It should be appreciated that any number or combination of intervening components can exist (including no intervening components).

Figure 1:
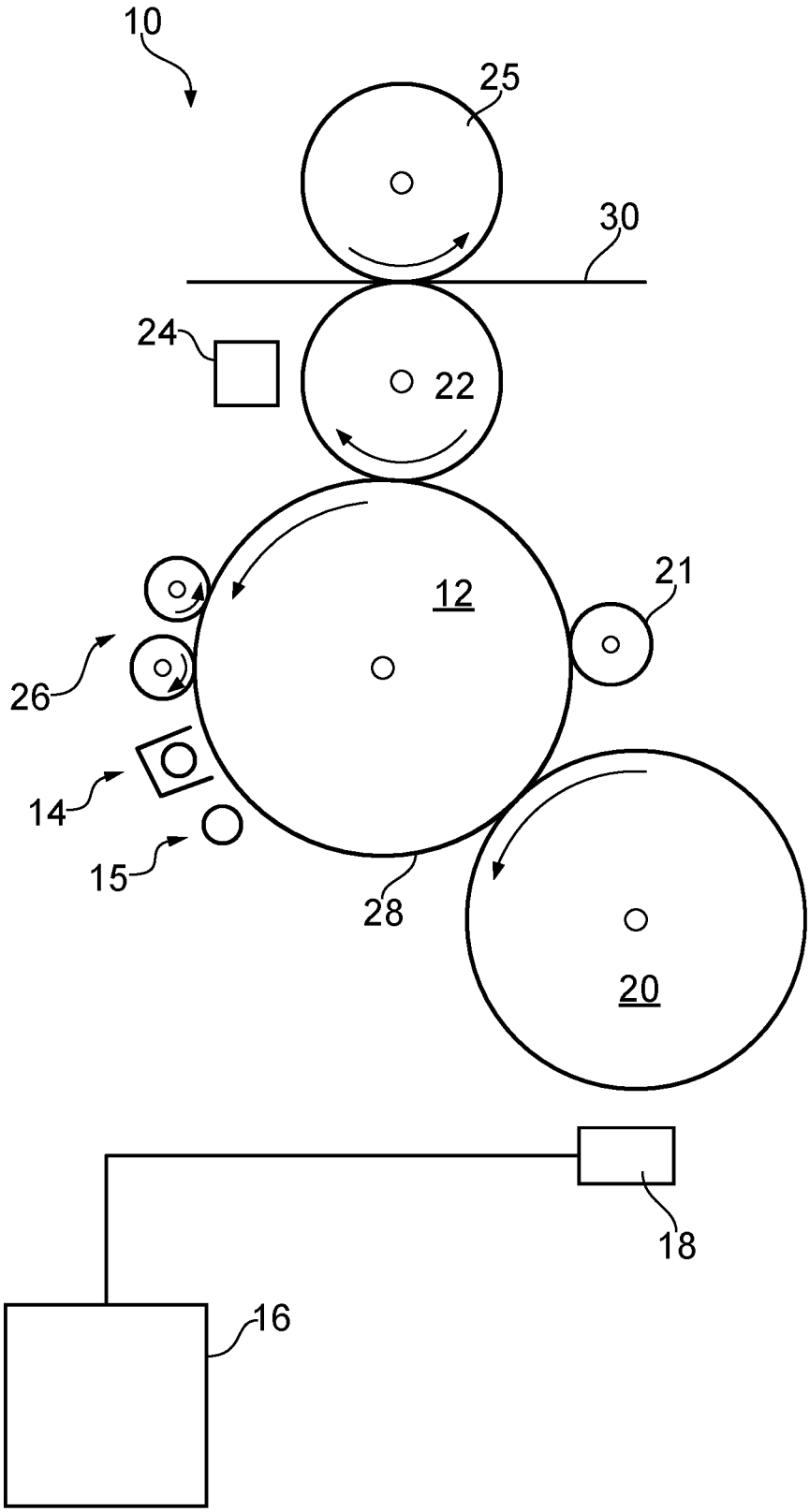
FIG. 1 illustrates a schematic diagram of liquid electrophotography apparatus according to various examples of the invention.

FIG. 1 illustrates a schematic diagram of a liquid electrophotography apparatus 10 according to an example. The liquid electrophotography apparatus 10 includes a photoconductive drum 12, a photoconductor charging apparatus 14, an imaging apparatus 15, a container 16 of printing liquid, a spray assembly 18, a developer roller 20, an excess liquid removal assembly 21, an intermediate roller 22, a fuser 24, a pressure roller 25 and a cleaning assembly 26.

The photoconductive drum 12 defines an exterior surface 28 for bearing an image. The exterior surface 28 may include any suitable photoconductive material. For example, the exterior surface 28 may comprise an organic photoconductor such as zinc oxide or cadmium sulphide, or may comprise a semiconductor photoconductor such as silicon. The photoconductive drum 12 is configured to rotate in an anti-clockwise direction.

The photoconductor charging apparatus 14 is positioned adjacent the photoconductive drum 12. The photoconductor charging apparatus 14 includes an electrode that is arranged to electrically charge the exterior surface 28 of the photoconductive drum 12.

The imaging apparatus 15 is arranged to expose the exterior surface 28 of the photoconductive drum 12 to light. Light that is incident on the exterior surface 28 of the photoconductive drum 12 causes re-arrangement of the electrical charge on the surface 28 and thus forms an image on the surface 28. The image formed on the surface 28 usually comprises image areas at a first electrical potential and background areas at another electrical potential.

The container 16 includes printing liquid and is arranged to provide the printing liquid to the spray assembly 18 (for example, via a pump). The container 16 may be replaceable by a user so that once the printing liquid is depleted, the user may install another container 16 in the liquid electrophotography apparatus that has printing liquid therein.

The printing liquid contained in the container 16 may be any suitable printing liquid for liquid electrophotography printing and may be conductive printing liquid. For example, the printing liquid may include at least one metal and/or at least one semiconductor and/or carbon black.

The spray assembly 18 is arranged to receive printing liquid from the container 16 and to provide the printing liquid to the developer roller 20. The spray assembly 18 may spray onto a downward facing portion of the developer roller 20 (the spray may be upward or with an upward directional component, as illustrated in FIG. 1). In other examples, the spray direction may be horizontal or it may have a downward component.

The developer roller 20 is positioned so that it is spaced from the photoconductive drum 12 and rotates in an anti-clockwise direction. The developer roller 20 is electrically charged at a different potential to the photoconductive drum 12. The developer roller 20 receives the printing liquid from the spray assembly 18 and provides the printing liquid to the photoconductive drum 12. Since the surface 28 of the photoconductive drum 12 is electrically charged by the photoconductor charging apparatus 14, the printing liquid forms the image on the photoconductive drum 12.

The excess liquid removal assembly 21 is arranged to remove excess printing liquid from the photoconductive drum 12. In various examples, the excess liquid removal assembly 21 may include a charged squeegee roller for removing excess printing liquid.

The intermediate roller 22 is positioned adjacent the photoconductive drum 12 and is arranged to rotate in a clockwise direction. The intermediate roller 22 includes a layer (which may also be referred to as a blanket) and is arranged so that printing liquid (and thus the image) is transferred from the photoconductive drum 12 to the blanket of the intermediate roller 12.

The fuser 24 is positioned adjacent the intermediate roller 22 and is arranged to provide heat to the printing liquid on the intermediate roller 22 to transform the printing liquid into a plastic film.

The pressure roller 25 is positioned adjacent the intermediate roller 22 and is arranged to rotate in an anti-clockwise direction. The pressure roller 22 and the photoconductive drum 12 define a nip for receiving a substrate 30 and for transferring the plastic film on the intermediate roller 22 to the substrate 30. The substrate 30 may be any media such as paper or a flexible substrate for a printed circuit board.

The cleaning assembly 26 may be any suitable cleaning station for removing printing liquid from the photoconductive drum 12. The cleaning assembly 26 may include at least one electrically charged roller for removing printing liquid.

It should be appreciated that a plurality of members of the liquid electrophotography apparatus 10 define a flow path for the printing liquid. The wording 'flow path' should be understood to mean the path or route which the printing liquid takes within at least a part of the liquid electrophotography apparatus and the printing liquid may flow between the members (for example, via an electric field) and be transferred between the members (for example, through physical contact between the members). For example, the photoconductive drum 12, the photoconductor charging apparatus 14, the developer roller 20, the excess liquid removal assembly 21, the intermediate roller 22, and the cleaning assembly 26 define a flow path for the printing liquid provided by the spray assembly 18. At least some members of this plurality of members are arranged to generate an electric field and at least one of these members (hereinafter referred to as the first member) is at least partially covered by an insulation layer.

Figure 2:
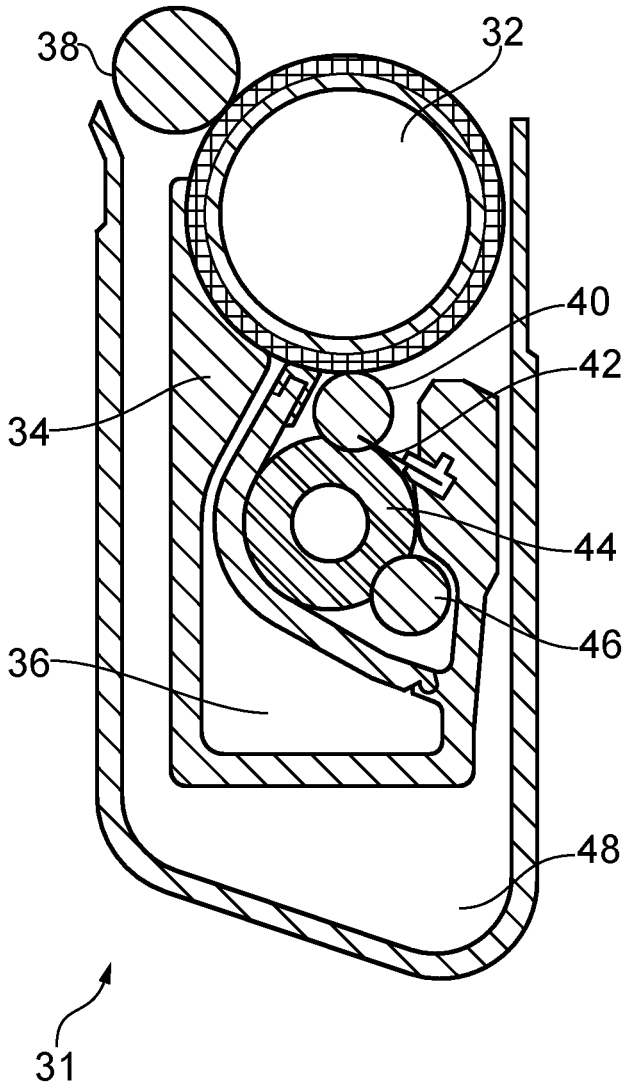
FIG. 2 illustrates a schematic diagram of another liquid electrophotography apparatus according to various examples of the invention.

FIG. 2 illustrates a schematic diagram of another liquid electrophotography apparatus 31 according to an example. The liquid electrophotography apparatus 31 is a development apparatus and includes a developer roller 32, an electrode 34, a printing liquid inlet 36, a squeegee roller 38, a cleaner roller 40, a wiper 42, a sponge roller 44, a squeeze roller 46 and a printing liquid outlet 48.

The developer roller 32 is arranged to rotate in a clockwise direction and receive printing liquid from the printing liquid inlet 36. The electrode 34 is arranged to electrically charge the developer roller 32. The squeegee roller 38 is arranged to remove excess printing liquid from the developer roller 32. The cleaner roller 40 is arranged to remove the printing liquid from the developer roller 32 so that the developer roller 32 may receive fresh printing liquid from the printing liquid inlet 36. The wiper 42 and the sponge roller 44 are arranged to remove the printing liquid from the cleaner roller 40 and the squeeze roller 46 is arranged to compress the sponge roller 44 to remove liquid from the sponge roller 44.

It should be appreciated that a plurality of members of the liquid electrophotography apparatus 31 define a flow path for the printing liquid. For example, the developer roller 32, the electrode 34, the squeegee roller 38, the cleaner roller 40, the wiper 42, the sponge roller 44 and the squeeze roller 46 define a flow path for the printing liquid provided by the printing liquid inlet 36. At least some members of this plurality of members are arranged to generate an electric field and at least one of these members (which may also be referred to as the first member) is at least partially covered by an insulation layer.

Figure 3:
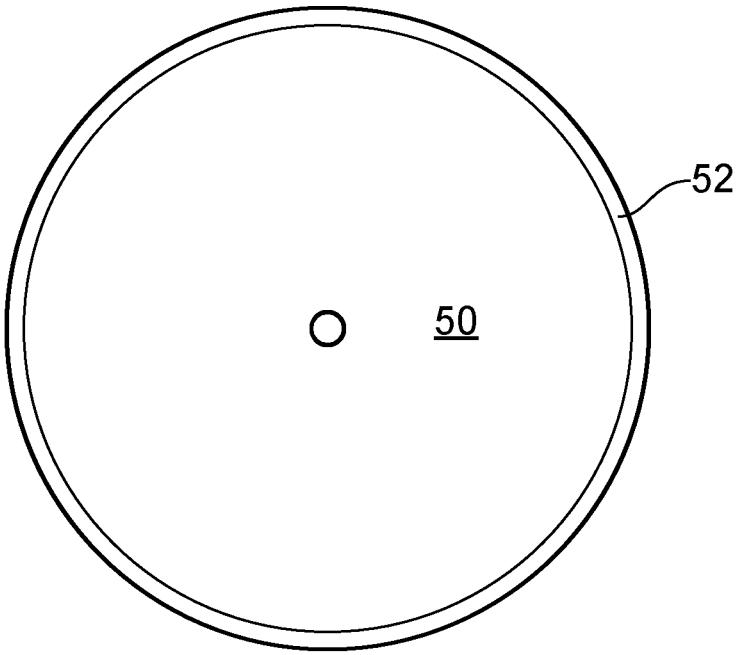
FIG. 3 illustrates a side view of a first member of a liquid electrophotography apparatus according to various examples of the invention.

FIG. 3 illustrates a side view of a first member 50 of a liquid electrophotography apparatus 10, 31 according to an example. The first member 50 may be a part of a development apparatus (for example, it may be the developer roller 20 illustrated in FIG. 1 or one of the rollers illustrated in FIG. 2). In various examples, the first member 50 may be one of: the developer roller 20, the electrode 14, the cleaning roller 26 or the squeegee 21 of the liquid electrophotography apparatus 10 illustrated in FIG. 1. In other examples, the first member 50 may be one of: the developer roller 32, the electrode 34, the squeegee roller 38, the cleaning roller 40 or the wiper 42 of the liquid electrophotography apparatus 31 illustrated in FIG. 2

A first insulation layer 52 is arranged around at least a portion of a surface of the first member 50. In some examples, the first insulation layer 52 is arranged around the whole surface area of the first member 50. The first insulation layer 52 may be any suitable insulation layer and may include a photoresist film (such as SU8 for example).

The first insulation layer 52 is arranged to prevent electrical discharge from a printing liquid when the printing liquid forms a layer on the first member 50. In other words, the electric field of the first member 50 attracts the printing liquid which forms a layer on the first member 50 and the first insulation layer 52 prevents the flow of charge from the layer of the printing liquid to the first member 50.

In some examples, the liquid electrophotography apparatus 10 comprises a plurality of members that are at least partially covered by an insulation layer. For example, the liquid electrophotography apparatus 10 may comprise a second insulation layer arranged around at least a portion of a surface of a second member of the plurality of members for preventing electrical discharge from the printing liquid. The first insulation layer 34 may have a different resistivity to the second insulation layer.

The liquid electrophotography apparatus 10, 31 provide an advantage in that since the first member 50 of the liquid electrophotography apparatus 10, 31 is at least partially covered by an insulation layer, a layer of printing liquid may not be electrically discharged through contact with the first member 50. For example, where the first member 50 is the developer roller 20, 32, the printing liquid may not be discharged through contact with the developer roller 20, 32 and this may result in improved transfer of printing liquid between the developer roller 20, 32 and the photoconductive drum 12.

Consequently, the liquid electrophotography apparatus 10, 31 may be advantageously used to print relatively high quality conducting and semiconducting patterns on a substrate. For example, the liquid electrophotography apparatus 10, 31 may be used to print conductive traces on a printed circuit board. The liquid electrophotography apparatus 10, 31 may also be used to print relatively high quality graphical metallic images (based on conducting pigments such as aluminium) on a substrate. Additionally, the liquid electrophotography apparatus 10, 31 may be used to print high loaded carbon black based black ink.

Figure 4:
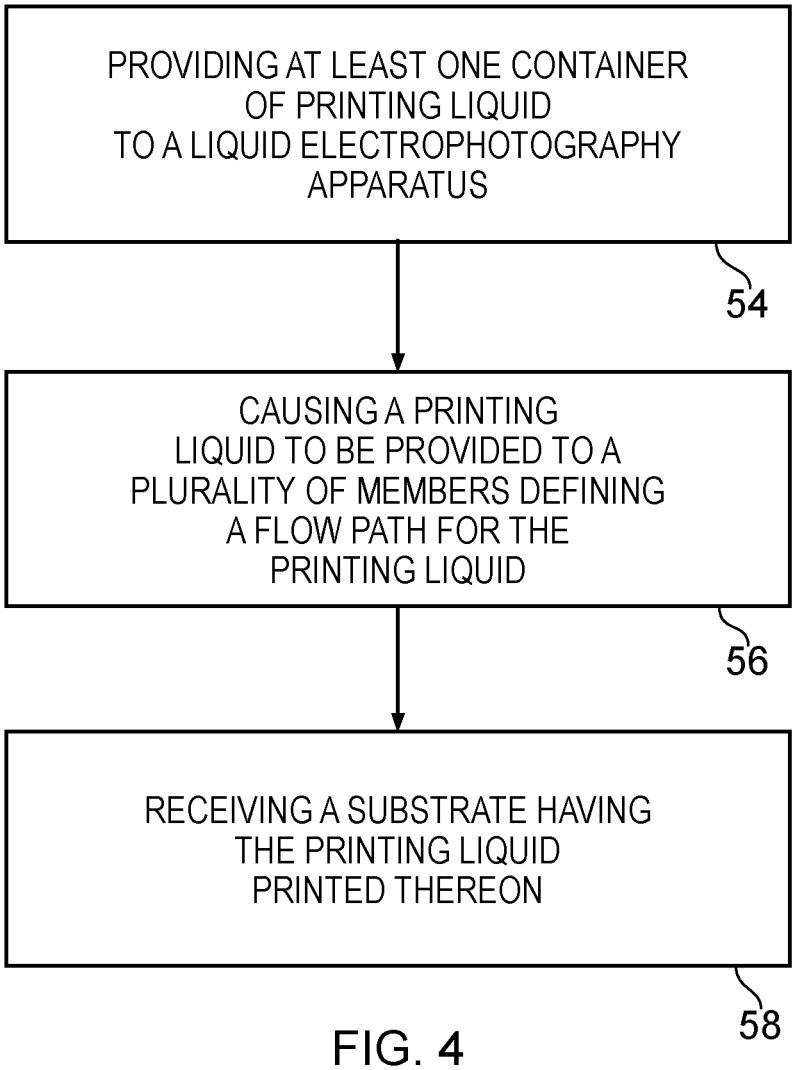
FIG. 4 illustrates a flow diagram of a method of operating a liquid electrophotography apparatus according to various examples of the invention.

FIG. 4 illustrates a flow diagram of a method of operating a liquid electrophotography apparatus 10, 31. At step 54, the method includes providing at least one container 16 of printing liquid to the liquid electrophotography apparatus 10, 31.

At step 56, the method includes causing the printing liquid to be provided to a plurality of members (such as the members 12, 14, 20, 21, 26, 32, 38, 40, 42) defining a flow path for the printing liquid. For example, a user may operate a user input device of the liquid electrophotography apparatus 10, 31 to initiate the apparatus 10, 31 and to cause the apparatus 10, 31 to print printing liquid on a substrate.

At step 58, the method includes receiving a substrate from the liquid electrophotography apparatus 10, 31 that has the printing liquid printed thereon.

The illustration of a particular order to the steps does not necessarily imply that there is a required or preferred order for the steps and the order and arrangement of the steps may be varied. Furthermore, it may be possible for some steps to be omitted (for example, step 54 may be not carried out each time the liquid electrophotography apparatus 10, 31 is operated).

Although examples have been described in the preceding paragraphs, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of examples of the invention believed to be of particular importance it should be understood that the Applicant claims protection in respect of any patentable feature or combination of features hereinbefore referred to and/or shown in the drawings whether or not particular emphasis has been placed thereon.

I claim:

1. A method of forming solid conducive traces on a substrate, the method comprising:

forming a charged pattern on a first insulated roller, wherein an insulation on the first insulated roller comprises a photoresist, wherein the photoresist comprises an electrostatic image forming surface;

transferring a liquid containing a conductive solid to charged portions of the first insulated roller to form a liquid pattern on the first insulated roller;

fusing material of the liquid pattern;

transferring the fused material onto a substrate; and solidifying the transferred, fused material on the substrate, where the solidified material is conductive.

2. The method of claim 1, where the solidified material comprises carbon black.

3. The method of claim 1, wherein the solidified material comprises a metal.

4. The method of claim 1, wherein the solidified material comprises a semiconductor.

5. The method of claim 3, wherein the substrate is a circuit board.

* * * * *